United States Patent [19]

Falconer et al.

[11] Patent Number: 4,875,252

[45] Date of Patent: Oct. 24, 1989

[54] SELF-CLOSING INVISIBLE HINGE WITH SELECTIVELY VARIABLE CLOSING FORCE

[75] Inventors: Donald R. Falconer, Swanton, Ohio; James C. Sneddon, Hillsdale, Mich.

[73] Assignee: Universal Industrial Products., a Division of Core Industries, Inc., Pioneer, Ohio

[21] Appl. No.: 215,240

[22] Filed: Jul. 5, 1988

[51] Int. Cl.[4] ..... E05D 7/00; E05F 1/12

[52] U.S. Cl. ..... 16/288; 16/301; 16/358; 16/370; 16/372; 16/379; 16/72

[58] Field of Search ..... 16/50, 54, 68, 72, 288, 16/300, 301, 358, 370, 372, 379

[56] References Cited

U.S. PATENT DOCUMENTS

| | | | |
|---|---|---|---|
| 882,721 | 3/1908 | Soss | 16/358 X |
| 1,687,271 | 10/1928 | Soss | 16/358 |
| 1,731,561 | 10/1929 | Campbell et al. | 16/50 |
| 1,984,092 | 12/1934 | Soss | 16/379 X |
| 2,035,823 | 3/1936 | Moore | 16/301 X |
| 3,001,224 | 9/1961 | Soss | 16/379 |
| 3,004,280 | 10/1961 | Stein | 16/54 |
| 3,903,567 | 9/1975 | Suska | 16/301 |

FOREIGN PATENT DOCUMENTS

| | | | |
|---|---|---|---|
| 22320 | of 1896 | United Kingdom | 16/72 |

*Primary Examiner*—Nicholas P. Godici
*Assistant Examiner*—William Scott Andes
*Attorney, Agent, or Firm*—Harness, Dickey & Pierce

[57] ABSTRACT

A self-closing invisible hinge for returning a door to its closed position from its open position including a self-closing structure in which the closing force can be selectively adjusted externally at the hinge and in which the self-closing structure is compact.

11 Claims, 2 Drawing Sheets

SELF-CLOSING INVISIBLE HINGE WITH SELECTIVELY VARIABLE CLOSING FORCE

SUMMARY BACKGROUND OF THE INVENTION

The present invention relates to a self-closing invisible hinge.

The invisible hinge of the present invention is generally of the type shown in U.S. Pat. No. 1,687,271 issued on Oct. 9, 1928 to J. Soss. The advantages of the invisible hinge of the type noted are well known in the art. However, in some applications, it is desirable that the hinge be self-closing. A self-closing structure for such a hinge is shown in the U.S. Pat. No. 3,004,280 issued on Oct. 17, 1961 to J. P.Stein. That structure, however, utilizes a complex hydraulic piston and spring combination in which regulation of the closure and latching rates are controlled via adjustable valves. The valves are a part of the hydraulic mechanism which is mounted in a cavity in the associated member of the door and wall combination. The valves, however, require an enlarged cavity portion enclosed by a removable cover plate which must be removed for access and replaced. In the present invention a simple hinge closure structure is provided utilizing a spring and an adjustment rod. The adjustment rod is selectively operable for varying the compression of the spring whereby the rate of closure can be adjusted. One end of the adjustment rod is fixed to and easily, externally accessible at one of the hinge members. The adjustment rod has an end structure such that it can be threaded more or less into a cooperating member by a common tool, i.e. Allen wrench, screw driver, etc. whereby the adjustment can be made. Thus the present invention provides a simple self-closing invisible hinge construction in which the closure rate can be selectively adjusted by a readily, externally accessible member.

Therefore, it is an object of the present invention to provide a new and unique self-closing invisible hinge structure.

It is another object to provide a new and unique self-closing invisible hinge having a simple construction.

It is another object of the present invention to provide a new and unique self-closing invisible hinge having a construction by which the closure force can be selectively adjustable by means readily accessible and external from the associated door and/or wall.

It is still another object of the present invention to provide a new and unique self-closing invisible hinge utilizing the compression of a spring to provide the closure force with the magnitude of the spring compression and hence closure force being selectively variable through a member readily, externally accessible at the hinge.

Other objects, features, and advantages of the present invention will become apparent from the subsequent description and the appended claims, taken in conjunction with the accompanying drawings, in which:

Figure 1:
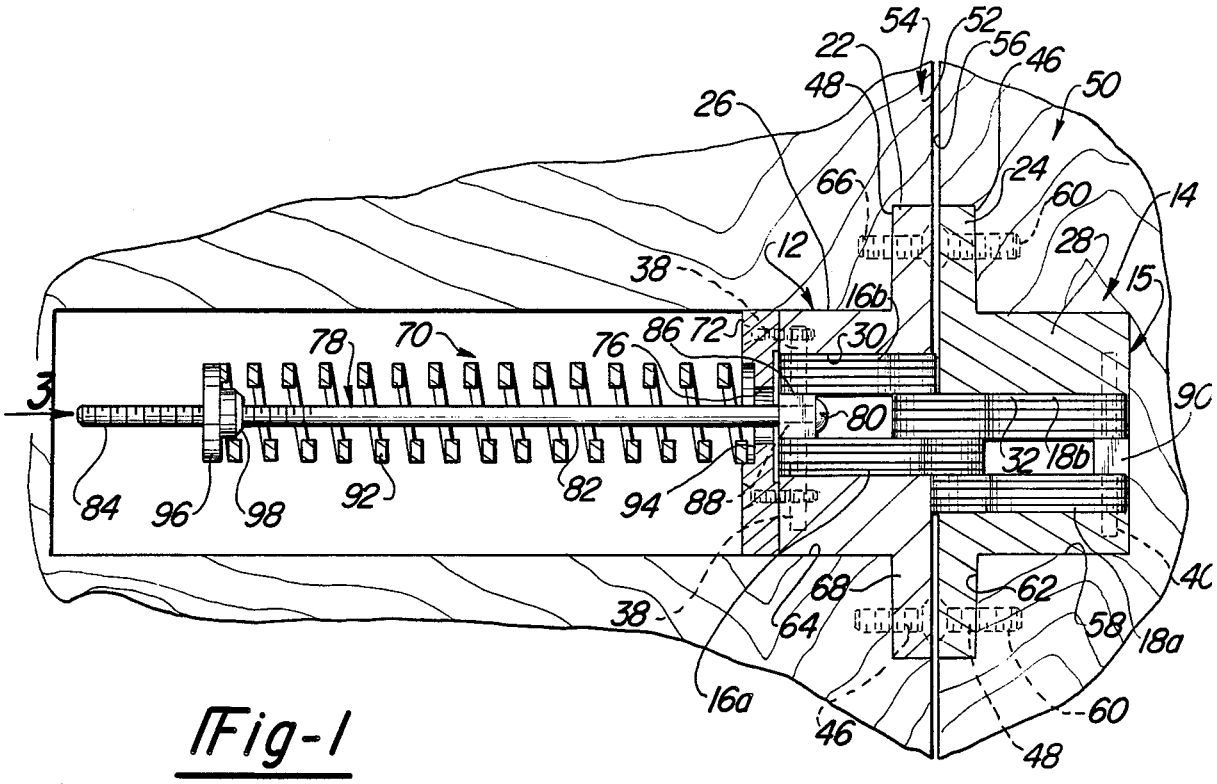
FIG. 1 is a side elevational view with some parts shown in section of an invisible hinge and self-closing structure with a door and associated wall partially shown in section, with the hinge and hence door in their closed positions.

Looking now to the drawings, an invisible hinge 10 is shown and includes a pair of butt members or hinge bodies 12 and 14 connected by a link assembly 15. The assembly 15 includes two pairs of link members with link members **16*a* and 16*b* being one pair and link members 18*a* and 18*b* being the other pair. The link members 16*a*, 16*b*, 18*a* and 18*b* are similarly constructed and are formed from a lamination of a plurality of relatively thin sheet metal plates with the opposite outer layers being coated to provide surfaces having good lubricity. In the form of the invention as shown the opposite outer layers were of a relatively thin nylon construction with the inner layers being of a thicker sheet metal construction. The links 16*a*, 16*b* and 18*a*, 18*b* are generally V-shaped with the outer edge surfaces angulated generally at an angle 'a' of around 120° relative to each other (see FIG. 5). The links 16*a*, 16*b* and 18*a*, 18*b* have a short and a long let portion and are pivotally connected together at their apexes via a rivet pin 20 which is headed at its opposite ends to hingedly connect the links 16*a*, 16*b* and 18*a*, 18*b* together as the link assembly 15 (see FIG. 5). In this regard the first pair of links 16*a* and 16*b* are interleaved with the second pair of links 18*a* and 18*b***.

The hinge bodies 12 and 14 are identically constructed and each has an elongated mounting plate portion 22 and 24, respectively, and a reduced size extension portion 26 and 28, respectively. Generally L-shaped slots or openings 30 and 32 extend across the front face of the mounting plate portion and through one side of each of the hinge bodies 12 and 14, respectively. The link assembly 15 has opposite ends located within the openings 30 and 32 with the ends of the short leg portions of links **16*a* and 16*b* pivotally connected to hinge body 12 via a fixed pivot pin 34 extending through aligned openings 35, 37 in extension portion 26 and in links 16*a* and 16*b*. Likewise, the ends of the short leg portions of the links 18*a* and 18*b* are pivotally connected tohinge body 12 via a fixed pivot pin 36 extending through aligned openings 35, 37 in extension portion 26 and in links 18*a* and 18*b***.

Figure 5:
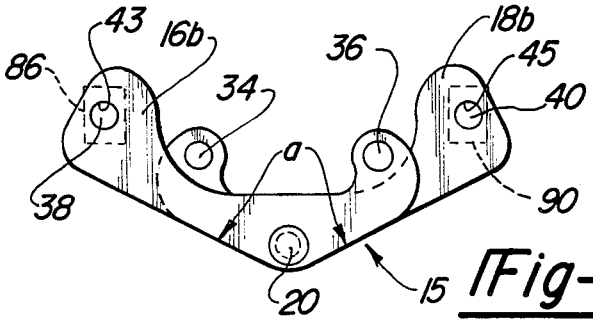
FIG. 5 is a top elevational view of a link assembly shown in the self closing hinge of FIGS. 1–4.

The opposite ends of the long leg portions of the first pair of links **16*a* and 16*b* are pivotally connected together via a movable guide pin 38 extending through aligned openings 43 while the opposite ends of the of the long leg portions of the second pair of links 18*a* and 18*b* are pivotally connected together via a movable guide pin 40 extending through aligned openings 45** (see FIG. 5).

Figure 4:
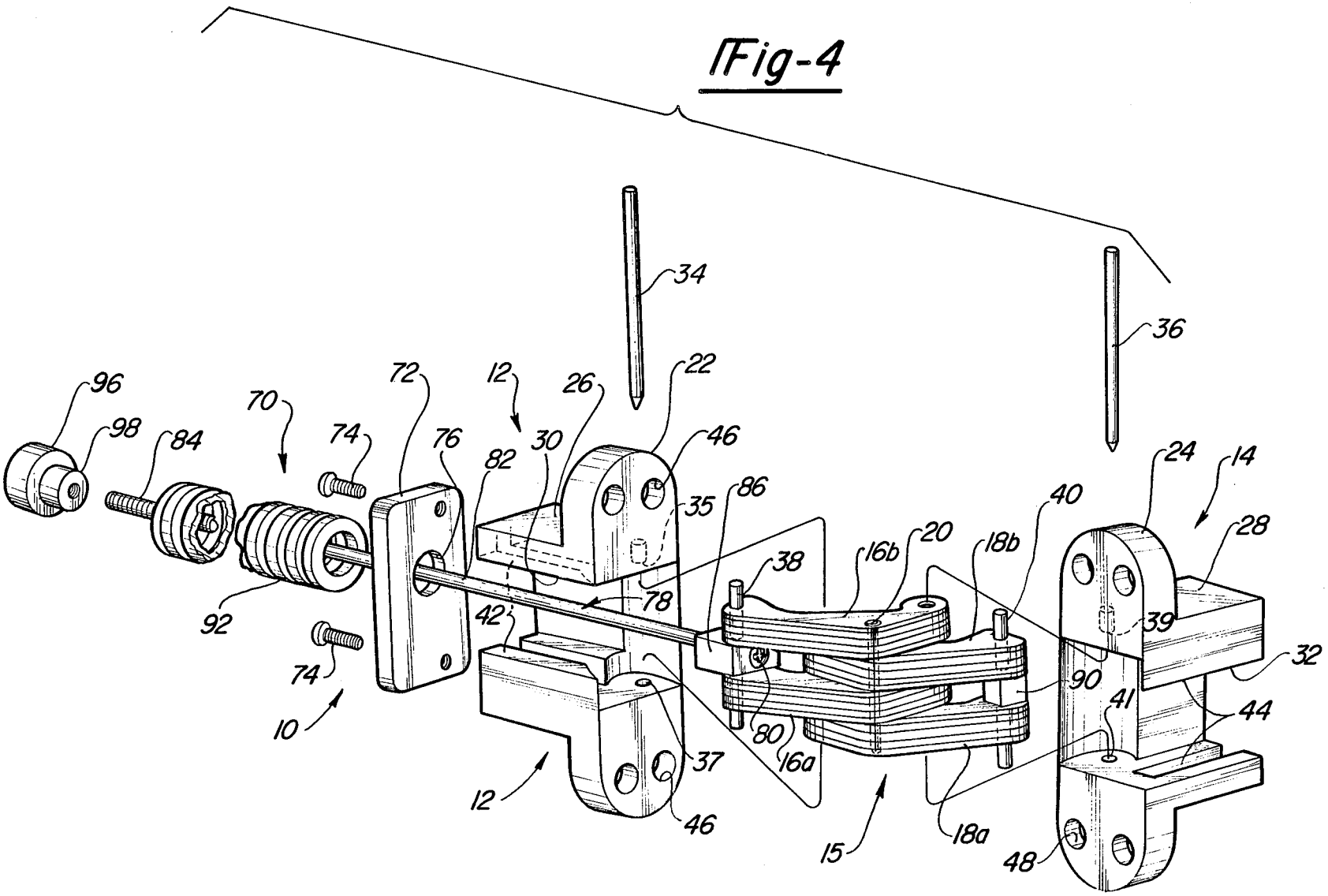
FIG. 4 is a pictorial, partially exploded, view with some parts shown broken away and in section of the invisible hinge and self-closing structure of FIGS. 1–3 with the hinge in a 90° open position.

The extreme ends of guide pin 38 extend outwardly from opposite sides of links **16*a* and 16*b* and are guidingly located in guide channels 43 formed within the upper and lower surfaces of opening 30. Similarly the extreme ends of guide pin 40 extend outwardly from opposite sides of links 18*a* and 18*b* and are guidingly located in guide channels 44 formed within the upper and lower surfaces of opening 32**. In this way the link assembly 15 and hinge bodies 12 and 14 are connected together such that the hinge bodies 12 and 14 can be moved to a closed position i.e. in which the hinge bodies 12 and 14 are in face to face, closed alignment (see FIG. 1), or moved to open positions including a 90° open position (FIG. 4) or to a 180° open position i.e. in which the hinge bodies 12 and 14 are swung outwardly to be located in a side-by-side fully open relationship (see FIG. 2). In this regard the pairs of links 16*a*, 16*b* and 18*a*, 18*b* will, in a sense, be folded together inwardly into a nested position in the openings 30 and 32 of hinge bodies 12 and 14, respectively, in the closed condition and will be folded outwardly from openings 30 and 32 into an open position in the open condition. Mounting holes 46 in the mounting plate portion 22 and mounting holes 48 in plate portion 24 facilitate mounting of the hinge bodies 12 and 14, respectively, to associated members to be hinged together.

As shown in the drawings, the invisible hinge 10 is adapted to hinge a door 50 to the end 52 of a wall 54. Thus the confronting end 56 of door 50 is recessed as at 58 to receive the extension portion 28 of hinge body 14 and be secured thereto via threaded fasteners 60 through mounting holes 48. The recess 58 has an enlarged stepped portion 62 to secure the mounting plate portion 24 to provide a generally flush surface. The wall 54 is generally hollow but has its end 52 formed with an opening 64 to receive the extension portion 26 of hinge body 12 and be secured to the end 52 via threaded fasteners 66 through mounting holes 46. An enlarged stepped portion 68 about the wall opening 64 receives the mounting plate portion 22 to provide a generally flush surface.

The preceding describes an invisible hinge structure generally operating in the manner shown and described in the referenced United States patents. Of course, a plurality of hinges could be used to secure the door 50 to the wall 54.

The invisible hinge 10, however, has been modified to operate with a closing structure 70 such that it is self-closing. Thus an end plate 72 is secured to the end of extension portion 26 of hinge body 12 via a pair of threaded fasteners 74. The end plate 72 generally closes the open end of through opening 30 of hinge body 12 but has a through bore 76 aligned therewith for a purpose to be seen. An elongated adjustment rod 78 has an enlarged head 80 at its outer end and a shank portion 82 with a threaded portion 84 at its inner end. The movable pivot pin 38 has an enlarged center portion 86 adapted to be located between the movable ends of links 16*a* and 16*b* and has a transversely extending through bore 88 adapted to receive the shank portion 82 of adjustment rod 78 in clearance relationship. The enlarged head 80 will then engage the center portion 86. The enlarged center portion 86 also helps to maintain the desired alignment and support the associated ends of the links 16*a*, 16*b*. The guide pin 40, at the moving ends of the links 18*a* and 18*b*, is also formed to have an enlarged center portion 90 which also helps to maintain the desired alignment and support the associated moving ends of the links 18*a*, 18*b*.

A helical coil spring 92 is located around the shank portion 82 of adjustment rod 78 and has one end in abutment with the end plate 72 and located within a counter bore 94. The counter bore 94 acts to pilot and positively hold the associated end of the spring 92 in the desired position about the shank portion 82 of adjustment rod 78. The opposite end of the spring 92 is engaged with a retaining ring 96 which is in threaded engagement with the threaded end portion 84 of the adjustment rod 78. A reduced diameter portion 98 of retaining ring 96 fits within the associated end of spring 92 to pilot that end of the spring 92 relative to the retaining ring 96.

The self closing structure 70 can be readily located within the hollow space or a suitable cavity in the wall 54 and inserted from the end 52 through the wall opening 64. Similarly where the associated door is of a hollow construction the self closing structure 70 could be readily located in the hollow space in the door. Note that the area of projection of the extension portions 26 and 28 does not extend outside of the periphery of the respective mounting plate portions 22 and 24. In this regard, it should further be noted that the area of projection of the outer surface of the self closing structure 70 does not extend outside of the periphery of the area of the extension portion 26. In this way the wall opening 64 through the end 52 of wall 54 need be no larger than required to accept the extension portion 26 of hinge body 12. This results in a compact structure and simplifies assembly of the hinge 10 and self closing structure 70 to the wall 54 and door 50.

Figure 2:
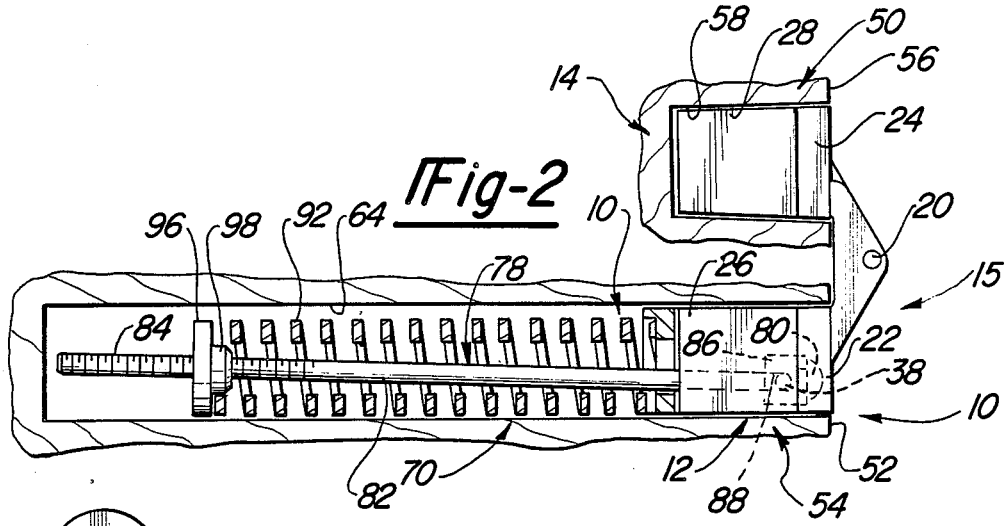
FIG. 2 is a top elevational view of the structure of FIG. 1 with the self closing hinge and hence door shown in a full, 180° open position.
Figure 3:
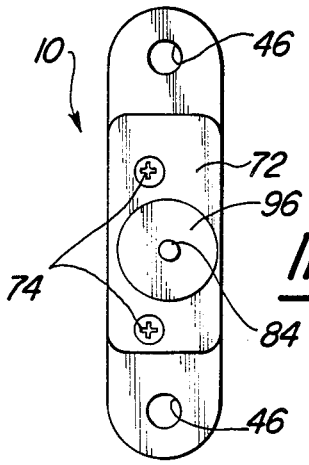
FIG. 3 is an end elevational view of the self closing hinge structure of FIG. 2 taken generally in the direction of the Arrow 3 in FIG. 1.

The initial compressive force of spring 92 will normally bias the door 50 to its closed position (FIG. 1). When the door 50 is opened, the compressive force on the spring 92 is increased. Thus when the door 50 is released the compressive force of spring 92 acting, through the pivotal connections of hinge bodies 12 and 14 will move the door 50 back to its closed position. The compression of the spring 92 can be varied by threading the retaining ring 96 more or less onto the threaded end portion 84 of adjustment rod 78. Note that the door 50 can be opened to a 180° open position (FIG. 2).

The enlarged head 80 of the adjustment rod 78 is formed with an irregular depression or surface such as a cross slot or a hexagonally shaped cavity. In this way the adjustment rod 78 can be manipulated by a screw driver, an Allen head wrench, etc. In the form of the invention shown the head 80 is of a button head construction with the cavity shaped to accept a standard Allen head wrench. Other suitable shapes could be provided. In order to select the desired closure force of the spring 92, the magnitude of its compression can be varied simply by rotating the adjustment rod 78 whereby the retaining ring 96 will be moved along the threaded end portion 84 to increase or decrease that compressive force. Thus in this way the closure force on the invisible hinge 10 and hence on door 50 can be selectively varied. The force of the spring 92 against the retaining ring 96 will inhibit rotation of the retaining ring 96 with the adjustment rod 80. Note that the closure force adjustment can be readily made since the enlarged head 80 of the adjustment rod 78 is readily accessible externally of the wall 54 and /or door 50.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. In a door connected to an associated wall by a hinge structure for swinging movement relative to the wall and adapted to be moved between closed and open positions, the invention comprising:

a self-closing invisible hinge for supporting the door to the wall for swinging movement between the closed and open positions and for urging and returning the door to its closed position from its open position, said self-closing invisible hinge comprising a pair of hinge bodies, each of said hinge bodies having a generally elongated mounting plate and an extension portion extending inwardly from said mounting plate, said extension portion being of a smaller cross section than that of said mounting plate and having a projected area against said mounting plate located within the confines of the perimeter of said mounting plate, each said hinge bodies having an opening extending therethrough, said opening having upper and lower surfaces and a side surface, a pair of upper and lower guide slots located in said upper and lower surfaces, a pair of alignment slots located in said side surfaces, link means connected to said hinge bodies for permitting swinging movememt of said hinge bodies relative to each other and hence swinging movement of the door relative to the wall between its closed and open positions, fastening means operatively connected with said mounting plates for connecting said hinge bodies to the door and the wall, said link means comprising a first pair of link members and a second pair of link members, each of said link members having a generally triangular shape defined by leg portions extending divergingly from the apexes of said triangular shape, a pivot pin pivotally connecting said first and second pairs of link members together generally at their apexes with said first pair of link members being alternately interleaved with said second pair of link members, one of the ends of said first pair of link members being located in said side slots in one of said hinge bodies and being pivotally held there by a first pivot pin, one of the ends of said second pair of link members being located in said side slots in the other of said hinge bodies and being pivotally held there by a second pivot pin, the opposite ends of said first pair of link members being connected together by a first guide pin having opposite ends located in said upper and lower guide slots in one of said hinge members, said first guide pin having a first enlarged intermediate portion located between said first and second link members at said opposite ends of said first pair of link members, the opposite ends of said second pair of link members being connected together by a second guide pin having opposite ends located in said upper and lower guide slots in the other of said hinge members, said second guide pin having a second enlarged intermediate portion located between said first and second link members at said opposite ends of said second pair of link members, a back plate member secured to the back of said extension body portion of said one of said hinge bodies and substantially closing said opening associated therewith, a coil spring member of generally uniform diameter and having one end adapted to engage said back plate member, an adjustment rod having an elongated shank portion extending through a first opening through said first enlarged intermediate portion and extending through a second opening in said back plate member and extending generally concentrically with said coil spring, said adjustment rod having an enlarged head portion at one end larger than said first opening and adapted to engage said first enlarged intermediate portion, said shank being threaded at its opposite end portion, a retainer member located at the opposite end of said coil spring and adapted to engage said opposite end, said retainer member having a threaded bore adapted to threadably engage said threaded end portion of said shank, said spring member adapted to provide a bias between said first and second link members and said hinge bodies to provide a bias urging said hinge bodies to the closed position, said enlarged head having an irregular surface adapted to be engageable whereby an operator can manually thread said shank more or less into said threaded bore of said retainer member, whereby the bias of said spring member relative to said first and second pairs of link members and said hinge bodies can be selectively varied by the operator, said enlarged lead being accessible to the operator when said hinge bodies are in the open position whereby the selective adjustment can be made externally of the door and wall, said coil spring and said retainer member having a cross section when projected against said extension portion being within the confines of the perimeter of said extension portion.

2. In a door connected to an associated wall by a hinge structure for swinging movement relative to the wall and adapted to be moved between closed and open positions, the invention comprising:

a self-closing invisible hinge for supporting the door to the wall for swinging movement between the closed and open positions and for urging and returning the door to its closed position from its open position, said self-closing invisible hinge comprising a pair of hinge bodies, each of said hinge bodies having a generally elongated mounting plate and an extension portion extending inwardly from said mounting plate, said extension portion being of a smaller cross section than that of said mounting plate and having a projected area against said mounting plate located within the confines of the perimeter of said mounting plate, each said hinge bodies having an opening extending therethrough, said opening having upper and lower surfaces and a side surface, a pair of upper and lower guide slots located in said upper and lower surfaces, a pair of alignment slots located in said side surfaces, link means connected to said hinge bodies for permitting swinging movement of said hinge bodies relative to each other and hence swinging movement of the door relative to the wall between its closed and open positions, fastening means operatively connected with said mounting plates for connecting said hinge bodies to the door and the wall, said link means comprising a first pair of link members and a second pair of link members, each of said link members having a generally triangular shape defined by leg portions extending divergingly from the apexes of said triangular shape, a pivot pin pivotally connecting said first and second pairs of link members together generally at their apexes with said first pair of link members being alternately interleaved with said second pair of link members, one of the ends of said first pair of link members being located in said opening in one of said hinge bodies and being pivotally held there by a first pivot pin, one of the ends of said second pair of link members being located in said opening in the other of said hinge bodies and being pivotally held there by a second pivot pin, the opposite ends of said first pair of link members being connected together by a first guide pin having opposite ends located in said upper and lower guide slots in one of said hinge members, said first guide pin having a first enlarged intermediate portion located between said first and second link members at said opposite ends of said first pair of link members, the opposite ends of said second pair of link members being connected together by a second guide pin having opposite ends located in said upper and lower guide slots in the other of said hinge members, a coil spring member of generally uniform diameter and having one end operative against said extension body portion of said one of said hinge bodies, an adjustment rod having an elongated shank portion extending through a first opening through said enlarged intermediate portion and extending through said opening in said one of said hinge bodies and extending generally concentrically within said coil spring, said adjustment rod having an enlarged head portion at one end larger than said first opening and adapted to engage said enlarged intermediate portion, said shank being threaded at its opposite end portion, a retainer member located at the opposite end of said coil spring and adapted to engage said opposite end, said retainer member having a threaded bore adapted to threadably engage said threaded end portion of said shank, said spring member adapted to provide a bias between said first and second link members and said hinge bodies to provide a bias urging said hinge bodies to the closed position, said enlarged head having an irregular surface adapted to be engageable whereby an operator can manually thread said shank more or less into said threaded bore of said retainer member, whereby the bias of said spring member relative to said first and second pairs of link members and said hinge bodies can be selectively varied by the operator, said enlarged head being accessible to the operator when said hinge bodies are in the open position whereby the selective adjustment can be made externally of the door and wall, said coil spring and said retainer member having a cross section when projected against said extension portion being within the confines of the perimeter of said extension portion.

3. In a door connected to an associated wall by a hinge structure for swinging movement relative to the wall and adapted to be moved between closed and open positions, the invention comprising:

a self-closing invisible hinge for supporting the door to the wall for swinging movement between the closed and open positions and for urging and returning the door to its closed position from its open position, said self-closing invisible hinge comprising a pair of hinge bodies, each of said hinge bodies having a mounting plate and an extension portion extending inwardly from said mounting plate, each said hinge bodies having an opening extending therethrough, said opening having upper and lower surfaces and a side surface, a pair of upper and lower guide slots located in said upper and lower surfaces, link means connected to said hinge bodies for permitting swinging movement of said hinge bodies relative to each other and hence swinging movement of the door relative to the wall between its closed and open positions, fastening means operatively connected with said mounting plates for connecting said hinge bodies to the door and the wall, said link means comprising a first pair of link members and a second pair of link members, each of said link members having a generally triangular shape defined by leg portions extending divergingly fromt he apexes of said triangular shape, a pivot pin pivotally connecting said first and second pairs of link members together generally at their apexes with said first pair of link members being alternately interleaved with said second pair of link members, one of the ends of said first pair of link members being located in said opening in one of said hinge bodies and being pivotally held there by a first pivot pin, one of the ends of said second pair of link members being located in said opening in the other of said hinge bodies and being pivotally held there by a second pivot pin, the opposite ends of said first pair of link members being connected together by a first guide pin having opposite ends located in said upper and lower guide slots in one of said hinge members, said first guide pin having an enlarged intermediate portion located between said first and second link members at said opposite ends of said first pair of link members, the opposite ends of said second pair of link members being connected together by a second guide pin having opposite ends located in said upper and lower guide slots in the other of said hinge members, a coil spring member of generally uniform diameter and having one end operative against said extension body portion of said one of said hinge bodies, an adjustment rod having an elongated shank portion extending through a first opening through said enlarged intermediate portion and extending through said opening in said one of said hinge bodies and extending generally concentrically with said coil spring, said adjustment rod having an enlarged head portion at one end larger than said first opening and adapted to engage said intermediate portion, said shank being threaded at its opposite end portion, a retainer member located at the opposite end of said coil spring and adapted to engage said opposite end, said retainer member having a threaded bore adapted to threadably engage said threaded end portion of said shank, said spring member adapted to provide a bias between said first and second link members and said hinge bodies to provide a bias urging said hinge bodies to the closed position, said enlarged head having an irregular surface adapted to be engageable whereby an operator can manually thread said shank more or less into said threaded bore of said retainer member, whereby the bias of said spring member relative to said first and second pairs of link members and said hinge bodies can be selectively varied by the operator, said enlarged head being accessible to the operator when said hinge bodies are in the open position whereby the selective adjustment can be made externally of the door and wall.

4. In a door connected to an associated wall by a hinge structure for swinging movement relative to the wall and adapted to be moved between closed and open poisitions, the invention comprising:

a self-closing invisible hinge for supporting the door to the wall for swinging movement between the closed and open positions and for urging and returning the door to its closed position from its open position, said self-closing invisible hinge comprising a pair of hinge bodies, each of said hinge bodies having a generally elongated mounting plate and an extension portion extending inwardly from said mounting plate, said extension portion being of a smaller cross section than that of said mounting plate and having a projected area against said mounting plate located within the confines of the perimeter of said mounting plate, each said hinge bodies having an opening extending therethrough, said opening having upper and lower surfaces and a side surface, a pair of upper and lower guide slots located in said upper and lower surfaces, a pair of alignment slots located in said side surfaces, link means connected to said hinge bodies for permitting swinging movement of said hinge bodies relative to each other and hence swinging movement of the door relative to the wall between its closed and open positions, fastening means operatively connected with said mounting plates for connecting said hinge bodies to the door and the wall, said link means comprising a first pair of link members and a second pair of link members, each of said link members having a generally triangular shape defined by leg portions extending divergingly from the apexes of said triangular shape, a pivot pin pivotally connecting said first and second pairs of link members together generally at their apexes with said first pair of link members being alternately interleaved with said second pair of link members, one of the ends of said first pair of link members being located in said opening in one of said hinge bodies and being pivotally held there by a first pivot pin, one of the ends of said second pair of link members being located in said opening in the other of said hinge bodies and being pivotally held there by a second pivot pin, the opposite ends of said first pair of link members being connected together by a first guide pin having opposite ends located in said upper and lower guide slots in one of said hinge members, said first guide pin having an intermediate portion located between said first and second link membes at said opposite ends of said first pair of link members, the opposite ends of said second pair of link members being connected together by a second guide pin having opposite ends located in said upper and lower guide slots in the other of said hinge members, a coil spring member of generally uniform diameter and having one end operative against said extension body portion of said one of said hinge bodies, an adjustment rod having an elongated shank portion extending through a first opening through said intermediate portion and extending through said opening in said one of said hinge bodies and extending generally concentrically with said coil spring, said adjustment rod having an enlarged head portion at one end larger than said first opening and adapted to engage said intermediate portion, said shank being threaded at its opposite end portion, a retainer member located at the opposite end of said coil spring and adapted to engage said opposite end, said retainer member having a threaded bore adapted to threadably engage said threaded end portion of said shank, said spring member adapted to provide a bias between said first and second link members and said hinge bodies to provide a bias urging said hinge bodies to the closed position, said enlarged head having an irregular surface adapted to be engageable whereby an operator can manually thread said shank more or less into said threaded bore of said retainer member, whereby the bias of said spring member relative to said first and second pairs of link members and said hinge bodies can be selectively varied by the operator, said enlarged head being accessible to the operator when said hinge bodies are in the open position whereby the selective adjustment can be made externally of the door and wall, said coil spring and said retainer member having a cross section when projected against said extension portion being within the confines of the perimeter of said extension portion.

5. In a door connected to an associated wall by a hinge structure for swinging movement relative to the wall and adapted to be moved between closed and open positions, the invention comprising:

a self-closing invisible hinge for supporting the door to the wall for swinging movement between the closed and open positions and for urging and returning the door to its closed position from its open position, said self-closing invisible hinge comprising a pair of hinge bodies, each of said hinge bodies having a front portion and a rear portion, fastening means for connecting said hinge bodies to the associated one of the door and the wall with each said front portion facing outwardly from the associated one of the door and wall, link means connected to said hinge bodies for permitting swinging movement of said hinge bodies relative to each other and hence swinging movement of the door relative to the wall between its closed and open positions, closing means operatively connected between said link means and one of said hinge bodies for urging said link means and said hinge bodies to the closed position, said closing means comprising spring means for providing a spring bias between said link means and said one of said hinge bodies for urging said link means and said hinge bodies to the closed position, said closing means further comprising adjustment means operatively connected with said spring means and being operable for selectively varying the magnitude of said spring bias, said spring means and said adjustment means extending rearwardly from said rear portion of said one of said hinge bodies and adapted to be located and enclosed within an opening in the associated one of the door and wall, said adjustment means including an adjustment member having an adjustment portion externally accessible to a user through said front portin of said one of said hinge bodies at said link means when said link means is in the open position whereby the magnitude of said spring bias can be selected by manual manipulation by the user of said adjustment member via said adjustment portion.

6. The invention of claim 5 with said spring means comprising a coil spring, said adjustment member of said adjustment means being an elongated rod extending through said coil spring and terminating at its forward end in a head portion having an engaging surface externally accessible to the user through said front portion of said one of said hinge bodies at said link means.

7. The invention of claim 5 with said spring means comprising a coil spring, said adjustment member of said adjustment means being an elongated rod extending through said coil spring and terminating at its forward end in a head portion having an engaging surface externally accessible to the user through said front portion of said one of said hinge bodies at said link means, said adjustment means including a retaining member adapted to engage the rearward end of said coil spring and having a threaded bore, said adjustment rod having its rearward end threadably engaged with said threaded bore whereby rotational movement of said adjustment rod relative to said retaining member will vary said spring bias.

8. The invention of claim 5 with said spring means comprising a coil spring, said adjustment member of said adjustment means being an elongated rod extending through said coil spring and terminating at its forward end in a head portion having an engaging surface externally accessible to the user through said front portion of said one of said hinge bodies at said link means, said adjustment means including a retaining member adapted to engage the rearward end of said coil spring and having a threaded bore, said adjustment rod having its rearward end threadably engaged with said threaded bore whereby rotational movement of said adjustment rod relative to said retaining member will vary said spring bias, said adjustment means including a connecting member connected to said link means and to said forward end of said adjustment rod.

9. The invention of claim 5 with said spring means comprising a coil spring, said adjustment member of said adjustment means being an elongated rod extending through said coil spring and terminating at its forward end in a head portion having an engaging surface externally accessible to the user through said front portion of said one of said hinge bodies at said link means said adjustment means including a retaining member adapted to engage the rearward end of said coil spring and having a threaded bore, said adjustment rod having its rearward end threadably engaged with said threaded bore whereby rotational movement of said adjustment rod relative to said retaining member will vary said spring bias, said adjustment means including a connecting member connected to said link means and to said forward end of said adjustment rod, said link means including at least two link members, pivot means connecting said link means together, each of said hinge bodies having an opening for receiving said link members when in the closed position, guide means connecting each of said link members to a different one of said hinge bodies whereby said link members are guided to positions in and out of the associated ones of said opening, said guide means including pins connected to said link members, said connecting member including one of said pins.

10. The invention of claim 5 with said spring means comprising a coil spring, said adjustment member of said adjustment means being an elongated rod extending through said coil spring and terminating at its forward end in a head portion having an engaging surface externally accessible to the user through said front portion of said one of said hinge bodies at said link means, said adjustment means including a retaining member adapted to engage the rearward end of said coil spring and having a threaded bore, said adjustment rod having its rearward end threadably engaged with said threaded bore whereby rotational movement of said adjustment rod relative to said retaining member will vary said spring bias, said adjustment means including a connecting member connected to said link means and to said forward end of said adjustment rod, said link means including at least two link members, pivot means connecting said link means together, said one of said hinge bodies having an opening for receiving said link members when in the closed position, guide means connecting each of said link members to a different one of said hinge bodies whereby said link members are guided to positions in and out of the associated ones of said openings, said guide means including pins connected to said link members, said connecting member including one of said pins, each of said hinge bodies including an enlarged mounting plate defining said front portion at its forward end and a rearwardly extending extension portion of reduced cross section defining said rear portion at its rearward end, said adjustment means having a cross section when projected against said extension portion being generally within the confines of the projected area of the periphery of said extension portion.

11. In a door connected to an associated wall by a hinge structure for swinging movement relative to the wall and adapted to be moved between closed and open positions, the invention comprising:

a self-closing invisible hinge for supporting the door to the wall for swinging movement between the closed and open positions and for urging and returning the door to its closed position from its open position, said self-closing invisible hinge comprising a pair of hinge bodies, one of said hinge bodies including an enlarged mounting plate at its forward end and a rearwardly extending extension portion of reduced cross section at its rearward end, fastening means for connecting said hinge bodies to the associated one of the door and the wall with said mounting plate of said one of said hinge bodies facing outwardly from the associated one of the door and wall, link means connected to said hinge bodies for permitting swinging movement of said hinge bodies relative to each other and hence swinging movement of the door relative to the wall between its closed and open positions, closing means operatively connected between said link means and one of said hinge bodies for urging said link means and said hinge bodies to the closed position, said closing means comprising spring means for providing a spring bias between said link means and said one of said hinge bodies for urging said link means and said hinge bodies to the closed position, said closing means further comprising adjustment means operatively connected with said spring means and being operable for selectively varying the magnitude of said spring bias, said spring means and said adjustment means extending rearwardly from said extension portion of said one of said hinge bodies and adapted to be located and enclosed within an opening in the associated one of the door and wall, said adjustment means including an adjustment member having an adjustment portion externally accessible to a user through said mounting plate at said forward end of said one of said hinge bodies when said link means is in the open position whereby the magnitude of said spring bias can be selected by manual manipulation by the user of said adjustment member via said adjustment portion, said spring means comprising a coil spring, said adjustment member of said adjustment means being an elongated rod extending through said coil spring and terminating at its forward end in a head portion having an engaging surface externally accessible to the user through said mounting plate at said forward end of said one of said hinge bodies, said adjustment means including a retaining member adapted to engage the rearward end of said coil spring and having a threaded bore, said adjustment rod having its rearward end threadably engaged with said threaded bore whereby rotatinal movement of said adjustment rod relative to said retaining member will vary said spring bias, said adjustment means including a connecting member connected to said link means and to said end of said adjustment rod, said link means including at least two link members, pivot means connecting said link means together, each of said hinge bodies having an opening for receiving said link members when in the closed position, guide means connecting each of said link members to a different one of said hinge bodies whereby said link members are guided to positions in and out of the associated ones of said openings, said guide means including pins connected to said link members, said adjustment means having a cross section when projected against said extension portion being generally within the confines of the projected area of the periphery of said extension portion.

* * * * *

UNITED STATES PATENT AND TRADEMARK OFFICE

CERTIFICATE OF CORRECTION

PATENT NO. : 4,875,252

DATED : October 24, 1989

INVENTOR(S) : Donald R. Falconer et al.

It is certified that error appears in the above-identified patent and that said Letters Patent is hereby corrected as shown below:

Col. 2, line 30, delete "let" and substitute therefor --leg--.

Col. 2, line 50, delete "tohinge" and substitute therefor --to hinge--.

Col. 2, line 63, delete "43" and substitute therefor --42--.

Col. 6, line 31, Claim 1, delete "lead" and substitute therefor --head--.

Col. 8, line 34, Claim 3, delete "fromt he" and substitute therefor --from the--.

Col. 11, line 27, Claim 5, delete "portin" and substitute therefor --portion--.

Col. 12, line 10, Claim 9, after "means" insert --,--.

Col. 14, line 22, Claim 11, delete "rotatinal" and substitute therefor --rotational--.

Signed and Sealed this

Twenty-eighth Day of January, 1992

*Attest:*

HARRY F. MANBECK, JR.

*Attesting Officer*

*Commissioner of Patents and Trademarks*